United States Patent [19]

Wendel et al.

[11] 4,384,069

[45] May 17, 1983

[54] PAPER-COATING COMPOSITIONS

[75] Inventors: Kurt Wendel, Ludwigshafen; Günter Hirsch, Mutterstadt, both of Fed. Rep. of Germany

[73] Assignee: BASF Aktiengesellschaft, Ludwigshafen, Fed. Rep. of Germany

[21] Appl. No.: 298,162

[22] Filed: Aug. 31, 1981

Related U.S. Application Data

[63] Continuation of Ser. No. 117,020, Jan. 30, 1980, abandoned.

[30] Foreign Application Priority Data

Feb. 15, 1979 [DE] Fed. Rep. of Germany ..... 2905765

[51] Int. Cl.[3] ..... C08L 33/20; C08L 33/02; C08L 31/04; C08L 31/02

[52] U.S. Cl. ..... 524/521; 524/522; 524/523; 524/524

[58] Field of Search ..... 524/521, 522; 525/221, 525/222, 228, 234, 238

[56] References Cited

U.S. PATENT DOCUMENTS 3,892,675 7/1975 Clarke et al. ..... 252/301.25
3,985,698 10/1976 Matsudaira et al. ..... 524/501
4,102,843 7/1978 Sperry et al. ..... 524/219
4,157,995 6/1979 Schenck et al. ..... 524/513
4,258,104 3/1981 Lee et al. ..... 524/522

*Primary Examiner*—Lewis T. Jacobs
*Attorney, Agent, or Firm*—Oblon, Fisher, Spivak, McClelland & Maier

[57] ABSTRACT

An improved paper-coating composition which contains, per 100 parts by weight of a finely divided pigment, from 5 to 25 parts by weight of a copolymer A, in the form of an aqueous dispersion, as a binder, and from 0.5 to 10 parts by weight of a copolymer B, containing (a) from 20 to 70% by weight of copolymerized units of hydroxy-$C_2$–$C_4$-alkyl acrylates or hydroxy-$C_2$–$C_4$-alkyl methacrylates,
(b) from 10 to 50% by weight of copolymerized units of acrylic acid, methacrylic acid, maleic acid and/or monoesters of maleic acid and
(c) from 5 to 50% by weight of copolymerized units of acrylonitrile, methacrylonitrile, $C_1$–$C_4$-alkyl acrylates of $C_1$–$C_4$-alkyl methacrylates, or vinyl esters of saturated $C_2$–$C_4$-carboxylic acids as the co-binder, with or without from 0.1 to 2.0 parts by weight of an optical brightener which is activated by the co-binder. The paper-coating composition has high water retention.

3 Claims, No Drawings

PAPER-COATING COMPOSITIONS

This is a continuation of application Ser. No. 117,020, filed Jan. 30, 1980 now abandoned.

The present invention relates to a paper-coating composition which contains, per 100 parts by weight of a finely divided pigment, from 5 to 25 parts by weight of a copolymer A, having a glass transition temperature of from −40° to +50° C., in the form of an aqueous dispersion, and from 0.5 to 10 parts by weight of one or more high molecular weight carboxyl-containing copolymers B.

Conventionally, coated printing papers are prepared using paper-coating compositions which essentially comprise a pigment, for example kaolin, calcium carbonate or titanium dioxide, which is dispersed in water, and a binder. Whereas in the past the binders used were exclusively high molecular weight naturally occurring products, such as starch or casein, attempts are increasingly being made to replace the naturally occurring products entirely or partially by synthetic, high molecular weight polymers in the form of aqueous dispersions. Binders based on naturally occurring products have the disadvantages that they are not of constant quality, that they are prone to attack by microorganisms, that they must be digested before use by expensive processes and that they give brittle coatings. It is true that binders based on synthetic high molecular weight polymers do not show all the above disadvantages of the natural binders, but they are nevertheless not entirely satisfactory.

U.S. Pat. No. 3,081,198 discloses the use, as a binder for paper-coating compositions, of a mixture of an alkali-insoluble polymer dispersion and an alkali-soluble copolymer which contains from 15 to 40% by weight of an ethylenically unsaturated carboxylic acid as copolymerized units. Instead of the polymer dispersion, a binder based on naturally occurring products can also be used. However, the use of these binders in paper-coating compositions gives coated papers of insufficient water resistance. The conventional paper-coating compositions cannot be satisfactorily processed on high-speed coating equipment and have the further disadvantage that the binders which they contain do not allow conventional optical brighteners to display their effect.

It is an object of the present invention to provide a paper-coating composition which exhibits high water retention, and the binder of which allows any optical brighteners present to display their effect.

We have found that this object is achieved, according to the invention, by means of a paper-coating composition as described at the outset, if the copolymer B contains, as characteristic copolymerized monomer units (a) from 20 to 70% by weight of hydroxy-$C_2$–$C_4$-alkyl acrylates or hydroxy-$C_2$–$C_4$-alkyl methacrylates, (b) from 10 to 50% by weight of acrylic acid, methacrylic acid, maleic acid and/or maleic acid monoesters and (c) from 5 to 50% by weight of acrylonitrile, methacrylonitrile, $C_1$–$C_4$-alkyl acrylates or $C_1$–$C_4$-alkyl methacrylates, and vinyl esters of saturated $C_2$–$C_4$-carboxylic acids.

The above binder combination imparts high water retention to the paper-coating compositions according to the invention, so that the compositions can readily be processed on conventional coating equipment. Where paper-coating compositions containing optical whiteners are concerned, the copolymer B activates the optical brighteners.

Suitable copolymers A for use in the binder mixture are all commercial synthetic binders which are in the form of an aqueous dispersion. The polymers have a glass transition temperature of from −40° to +50° C. Examples of typical monomers from which these polymers are synthesized are esters of acrylic acid and of methacrylic acid, acrylonitrile, methacrylonitrile, acrylamide, methacrylamide, ethylenically unsaturated $C_3$–$C_5$-monocarboxylic and -dicarboxylic acids, monoesters of ethylenically unsaturated $C_3$–$C_5$-dicarboxylic acids, vinyl chloride, vinylidene chloride, ethylenically monounsaturated or poly-unsaturated hydrocarbons, eg. ethylene, propylene, butylene, 4-methylpent-1-ene, styrene, butadiene, isoprene and chloroprene, vinyl esters, vinyl-sulfonic acid and esters of ethylenically unsaturated carboxylic acids derived from polyhydric alcohols, eg. hydroxypropyl acrylate and hydroxypropyl methacrylate.

Examples of suitable copolymers A are known from German Published Application DAS No. 1,100,450. In addition to an acrylic acid ester, such copolymers may contain styrene and/or butadiene and/or acrylonitrile, as well as ethylenically unsaturated acids. In place of the acids, other hydrophilic polymerizable compounds may be present as units of the copolymer, for example hydroxyl-containing monomers, eg. hydroxypropyl acrylate and hydroxypropyl methacrylate. The acrylic esters employed in the polymerization may be derived, for example, from monohydric alcohols of 1 to 12 carbon atoms. The acrylic ester content of these copolymers can vary within wide limits, for example from 10 to 99%, and indeed homopolymers of acrylic esters may also be used. The content of ethylenically unsaturated acids in these copolymers is as a rule up to 10% by weight. Suitable ethylenically unsaturated acids are, in particular, acrylic acid, methacrylic acid, vinylsulfonic acid, acrylamidopropanesulfonic acid and itaconic acid.

The polymethacrylates have a similar structure to the polyacrylates but contain a methacrylic acid ester in place of an acrylic acid ester. However, it is also possible to copolymerize acrylic acid esters and methacrylic acid esters conjointly with other ethylenically unsaturated compounds and to use the product as constituent A of the binder combination.

Other suitable copolymers A are copolymers of butadiene and styrene. These contain from 20 to 60% by weight of butadiene and from 40 to 80% by weight of styrene with or without acrylonitrile. These copolymers may contain additional comonomers, for example esters of ethylenically unsaturated carboxylic acids of 3 to 5 carbon atoms, with or without up to 10% by weight of other ethylenically unsaturated copolymerizable compounds, eg. acrylic acid, methacrylic acid, maleic acid, crotonic acid or fumaric acid. Polymers of this type, as well as polyacrylates, are disclosed, for example, in German Pat. No. 1,546,316. Suitable styrene-butadiene copolymers which contain an ethylenically unsaturated carboxylic acid or a monoester of an ethylenically unsaturated dicarboxylic acid as copolymerized units and may be used as copolymers A are disclosed in German Published Application DAS No. 1,221,748.

Other copolymers A which may be used in the paper-coating composition according to the invention are derived from vinyl esters, eg. vinyl acetate or vinyl propionate, vinyl chloride or vinylidene chloride and polymerizable hydrocarbons, e.g. ethylene or propylene, for example copolymers of vinyl esters with acrylic acid esters and/or methacrylic acid esters and/or acrylonitrile as well as other polymerizable hydrophilic compounds, for example ethylenically unsaturated compounds, e.g. acrylamide, N-methylolacrylamide or N-methylolmethacrylamide. Suitable vinyl ester copolymers are disclosed, for example, in German Pat. No. 1,264,945. Homopolymers of vinyl esters may also be used.

The copolymers B are prepared by copolymerizing the monomer mixtures comprising (a) from 20 to 70% by weight of a compound of the formula

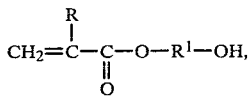

where R is H or —$CH_3$ and $R^1$ is branched or linear alkylene of 2 to 4 carbon atoms, (b) from 10 to 50% by weight of acrylic acid, methacrylic acid, maleic acid and/or maleic acid monoesters and (c) from 5 to 50% by weight of acrylonitrile, methacrylonitrile, esters of acrylic acid or methacrylic acid with monohydric $C_1$–$C_4$-alcohols and vinyl esters of saturated $C_2$–$C_4$-carboxylic acids, using conventional free radical polymerization initiators. The polymerization medium used is in particular water. Depending on the composition of the monomer mixture, a polymer solution or a polymer dispersion is obtained. Examples of suitable monomers of group (a) are esters of acrylic acid or methacrylic acid with ethylene glycol, 1,3-propylene glycol, 1,2-propylene glycol and 1,4-butanediol or the other isomeric butanediols, the molar ratio of acrylic acid or methacrylic acid to diol being 1:1. The preferred monomer of group (a) is hydroxypropyl acrylate; it preferably accounts for from 30 to 55% by weight of the structural units of the copolymer.

Amongst the comonomers of group (b), acrylic acid and/or methacrylic acid are particularly preferred. These preferably account for from 15 to 40% by weight of the structural units of the copolymer B. Amongst the maleic acid monoesters which may also be used as comonomers of group (b), those derived from monohydric alcohols or 1 to 4 carbon atoms are particularly suitable.

Suitable comonomers of group (c), which account for from 5 to 50, preferably from 20 to 40, % by weight of the units of the copolymer B, are acrylonitrile, methacrylonitrile, esters of acrylic acid or methacrylic acid with monohydric $C_1$–$C_4$-alcohols and vinyl esters of saturated $C_2$–$C_4$-carboxylic acids. Amongst the esters, methyl acrylate, ethyl acrylate, methyl methacrylate, vinyl acetate and vinyl propionate are particularly suitable. Preferably, the comonomer of group (c) is acrylonitrile, methyl acrylate and/or ethyl acrylate.

The polymerization of the monomers is started by means of the conventional polymerization initiators. For example, peroxides, eg. peroxydisulfates, hydrogen peroxide or hydroperoxides and azo compounds, as well as redox catalysts, may be used. To regulate the molecular weight of the copolymers, the conventional polymerization regulators may be used, for example mercaptans, eg. t-dodecylmercaptan, thioglycolic acid and the like, or hydroxylammonium salts.

As is usual with polymerization reactions, conventional emulsifiers are used to emulsify the water-insoluble or only very sparingly water-soluble comonomers. The copolymerization may for example be carried out batchwise in a stirred kettle by first introducing a part of the monomer mixture and then adding the remainder at the rate at which the polymerization proceeds. However, the reaction can also be carried out continuously in a cascade.

The paper-coating compositions according to the invention contain, per 100 parts by weight of pigment, from 5 to 25 parts by weight of polymer A and from 0.1 to 10 parts by weight of the solid copolymer B. These polymer combinations are excellent binders for paper-coating compositions. They are preferably used for the preparation of paper-coating compositions which contain from 0.1 to 2% by weight of an optical brightener. A summary of optical whiteners may be found, for example, in the article by H. Gold in Venkataraman, The Chemistry of Synthetic Dyes, Academic Press, New York and London 1971, volume 5, chapter 8, pages 536–679 (which is herewith incorporated by reference). Optical brighteners are commercially available and therefore do not require more detailed comment here. However, a more detailed characterization of this category of compounds may be found in German Laid-Open Application DOS No. 2,628,878 and German Published Application DAS No. 1,795,047 (which are herewith incorporated by reference). These publications describe optical brighteners based on stilbene derivatives, which are used preferentially.

To prepare the paper-coating compositions according to the invention, the copolymers A and B are mixed, in a conventional manner, with fillers and/or pigments. Suitable compounds of this type include, in particular, clay minerals, calcium carbonate, calcium aluminum pigments and titanium dioxide. Where appropriate, other assistants may also be added to the paper-coating compositions, for example alkalis, eg. sodium hydroxide, potassium hydroxide or ammonia, white pigments based on water-insoluble urea-formaldehyde condensation products, or other conventional paper assistants, eg. urea, melamine, melamine-formaldehyde resins and urea-formaldehyde resins. To achieve good dispersion of the ingredients, from 0.5 to 5% by weight of a dispersant, for example a low molecular weight polymer of acrylic acid, and in particular an ammonium salt or sodium salt of a polyacrylic acid having a K value of from 10 to 35, is as a rule employed. The sequence in which the individual components of the paper-coating composition are mixed is not critical; however, it is advantageous to add the copolymer B at the end of the process of preparation of the coating composition.

The copolymers B may be regarded as co-binders because they themselves possess pigment-binding capacity. Furthermore, in a partially neutralized or completely neutralized form, the copolymers B act as thickeners, ie. they increase the viscosity of the aqueous paper-coating composition. In addition, they increase the water retention of the coating composition and not only do not reduce the effectiveness of the optical brighteners but on the contrary even activate the latter. The effects described can be achieved even with relatively small amounts of the copolymer B; for example, from 0.1 to 10% by weight, preferably from 0.2 to 3% by weight, of the water-soluble copolymer B, the percentages being expressed as solids based on pigment weight, suffice to give the above improvements in the quality of the coating composition and of the paper.

The Examples which follow illustrate the invention. In the Examples, parts and percentages are by weight, unless stated otherwise. The K values of the polymers were measured by the method of H. Fikentscher, Cellulose-chemie 13 (1932), 58-64 and 71-74, in 0.5% strength aqueous solution at 25° C.; $K=k.10^3$. The K values of the copolymers B are from about 60 to 140, preferably from 80 to 120.

Preparation of the copolymers B

Copolymer B 1

The polymerization apparatus used is a 2 liter flask equipped with a stirrer, reflux condenser, thermometer and 2 feed vessels. The polymerization is carried out in the absence of oxygen, under a nitrogen atmosphere. The feed vessel I contains a mixture prepared as follows: 7 g of a 28% strength solution of a reaction product obtained by forming an adduct of 3 moles of ethylene oxide with 1 mole of a saturated aliphatic $C_{12}/C_{14}$-alcohol, sulfating and neutralizing the reaction product, are added to 548 g of water. To this mixture are added 140 g of acrylic acid neutralized with 156 g of 50% strength sodium hydroxide solution, 140 g of hydroxypropyl acrylate (a mixture of 1-hydroxy-prop-2-yl acrylate and 2-hydroxy-prop-1-yl acrylate in the weight ratio of about 33:67), 120 g of acrylonitrile and 0.8 g of hydroxylammonium sulfate.

The feed II consists of 100 g of water and 4 g of sodium peroxydisulfate. 10% of feed II and 274 g of water are initially introduced into the polymerization apparatus and heated to 90° C., whilst stirring. When this temperature is reached, feeds I and II are run in over 2 hours, with good mixing, and the polymerization is carried out at 90° C. Thereafter, a further 4 g of sodium peroxydisulfate dissolved in 100 g of water are added to the polymerization batch over 50 minutes. After continuing the polymerization for a further hour, the reaction mixture is cooled and is then filtered. An aqueous solution, of about 28% strength, of copolymer B 1 is obtained.

Copolymer B 2

The polymerization apparatus described in Example 1 is used. 335 g of water are introduced initially, and heated to 85° C. Feed I is a mixture of 670 g of water, 18 g of a 28% strength solution of the sodium salt of a sulfuric acid half-ester of an adduct of a $C_{12}/C_{14}$-alcohol mixture with 3 moles of ethylene oxide, 75 g of acrylic acid neutralized with 42 g of 50% strength sodium hydroxide solution, 200 g of methyl acrylate, 225 g of hydroxypropyl acrylate (a mixture of 1-hydroxy-prop-2-yl acrylate and 2-hydroxy-prop-1-yl acrylate in the weight ratio of about 33:67) and 0.75 g of dodecylmercaptan. Feed II is an aqueous solution of 5 g of sodium peroxydisulfate in 200 g of water. Feeds I and II are added in the course of 2.5 hours to the initially introduced water which is heated to 85° C., and the polymerization is carried out at the same temperature.

The polymerization is complete after heating at 85° C. for 2 hours following the addition of feeds I and II. The reaction mixture is then cooled and filtered. Copolymer B 2, having a K value of 89, is obtained in the form of a white emulsion of about 29% strength.

EXAMPLE 1

To prepare a paper-coating composition suitable for the production of paper and for producing an offset printing paper, 80 parts of coating clay and 20 parts of calcium carbonate pigment are dispersed, with the aid of a powerful dispersing device, in water, containing 0.2 part of sodium hydroxide solution of 50% strength and 0.3 part of a commercial dispersant based on a low molecular weight polyacrylic acid, to give an aqueous slurry of about 66% strength. To this are added 12 parts (based on solids content) of an aqueous dispersion of a copolymer A of 50% of n-butyl acrylate and 50% of styrene. Thereafter, 2 parts (based on solids) of copolymer B1, and 1 part of a commercial optical brightener based on stilbene derivatives (Blancophor PSG) are added with vigorous stirring, and the solids content of the coating composition is brought to about 58% by adding water. The pH of the coating composition is brought to 8.5 with sodium hydroxide solution. After mixing for 15 minutes, the paper-coating composition can be used, for example on a knife coater. The properties of the coating composition and of the papers coated therewith are shown in the Table.

EXAMPLE 2

A coating composition for the production of coated board is obtained, following the instructions in Example 1, if the pigment slurry described there is mixed with 15 parts, based on solids content of the dispersion, of a commercial butadiene-styrene copolymer (48% of butadiene, 48% of styrene and 4% of acrylic acid) in the form of a dispersion, as copolymer A, and water is added until the solids content of the mixture is 43%. Thereafter, based on solids content, 0.7 part of copolymer B 2 and 1 part of a commercial optical brightener based on stilbene derivatives (Blancophor PSG) are added. The pH is then brought to 8.5 and the mixture is homogenized for 15 minutes. The coating composition obtained can be satisfactorily applied on an air-knife coater or a metering-bar coater. The properties of the coating composition and of the board coated therewith are shown in the Table.

EXAMPLE 3

To formulate a coating composition for the production of art printing paper, 80 parts of coating clay and 20 parts of satin white are dispersed in water with the aid of 1.2 parts of a commercial dispersant based on low molecular weight polyacrylic acid and 0.2 part of sodium hydroxide solution, to give an aqueous slurry of about 54% strength. 16 parts of a copolymer A obtained from 50% of n-butyl acrylate and 50% of vinyl acetate are mixed into this pigment slurry. 2.5 parts, based on solids content, of copolymer B 2 and 1 part of a commercial optical brightener based on stilbene derivatives (Blancophor PSG) are then added, with vigorous stirring, and the solids content of the coating composition is brought to 50% by adding water. The pH is brought to 11.3 and the paper-coating composition is then mixed for a further 15 minutes. Thereafter, it can be applied satisfactorily on a knife coater. The results are shown in the Table.

The Table additionally shows properties of coating compositions and of coated papers which have been obtained in accordance with the Comparative Examples. In the latter, the difference from Examples 1 to 3 is that in place of copolymer B a synthetic or natural co-binder of the prior art was used in each case; in other respects, the paper-coating compositions were prepared as described in Examples 1 to 3.

Binders used for the paper-coating compositions in the Comparative Examples.

COMPARATIVE EXAMPLE 1

Copolymer A as described in Example 1, and casein in place of copolymer B 1.

COMPARATIVE EXAMPLE 2

Copolymer A as described in Example 2, and a commercial starch in place of copolymer B 2.

COMPARATIVE EXAMPLE 3

Copolymer A as described in Example 3 and a copolymer obtained from 12% of vinyl acetate, 30% of methyl acrylate and 12% of acrylic acid in place of copolymer B 2.

TABLE

| Properties | Example 1 | Comparative Example 1 | Example 2 | Comparative Example 2 | Example 3 | Comparative Example 3 |
|---|---|---|---|---|---|---|
| Viscosity [mPas] (Brookfield viscometer, 100 rpm) | 1,700 | 2,100 | 680 | 450 | 700 | 620 |
| Water retention [sec] | 90 | 66 | 90 | 74 | 46 | 34 |
| Whiteness (reflectance) (without UV filter) | 87.3 | 86.4 | 87.7 | 86.2 | 87.6 | 86.7 |
| Increase in whiteness Δ reflectance | 3.7 | 2.6 | 4.0 | 2.8 | 4.0 | 3.2 |

In examining the data given in the Table, it is seen that by proceeding according to the invention an increase in the water retention of the coating compositions, as well as an unforeseeable increase in the whiteness of the coated paper (due to activation of the optical brightener by the copolymers B1 and B2) is achieved.

The water retention has been quoted in seconds. It is the time within which the aqueous phase, dyed with an acid red dye, of the coating composition has penetrated through a Blauband filter to an extent that it has reduced the reflectance of the filter, measured with a reflectance photometer (filter 4), to 40% of the original value.

The whiteness has been quoted in terms of the percent reflectance, measured with UV-rich xenon light, without a filter. The increase in the whiteness relates to the corresponding value obtained with UV filters.

We claim:

1. A paper coating composition which contains, 100 parts by weight of a finely divided pigment, from 5 to 25 parts by weight of a copolymer A having a glass transition temperature of from −40° to +50° C., in the form of an aqueous dispersion, and from 0.5 to 10 parts by weight of one or more high molecular weight-containing copolymers B, wherein the improvement comprises using, as the copolymer B a copolymer having a K value of 60–140, which is prepared by solution copolymerization, and which contains:
   (a) from 20 to 70% by weight of copolymerized units of hydroxy-$C_2$–$C_4$-alkyl acrylates or hydroxy-$C_2$–$C_4$-alkyl methacrylates;
   (b) from 10 to 50% by weight of copolymerized units of compounds selected from the group comprising acrylic acid, methacrylic acid, maleic acid and monoesters of maleic acid; and
   (c) from 5 to 50% by weight of copolymerized units of compounds selected from the group comprising acrylonitrile, methacrylonitrile, $C_1$–$C_4$-alkyl acrylates or $C_1$–$C_4$-alkyl methacrylates, or vinyl esters of saturated $C_2$–$C_4$-carboxylic acids.

2. An improved paper-coating composition as claimed in claim 1, wherein copolymer B contains
   (a) from 30 to 55% by weight of hydroxypropyl acrylate units,
   (b) from 15 to 40% by weight of acrylic acid or methacrylic acid units and
   (c) from 20 to 40% by weight of acrylonitrile, methyl acrylate and/or ethyl acrylate units.

3. An improved paper-coating composition as claimed in claim 1, which contains from 0.1 to 2.0 parts by weight of an optical brightener.

* * * * *